US010520249B2

(12) United States Patent
Horne

(10) Patent No.: US 10,520,249 B2
(45) Date of Patent: Dec. 31, 2019

(54) PROCESS AND APPARATUS FOR PROCESSING A HYDROCARBON GAS STREAM

(71) Applicant: ENCANA CORPORATION, Calgary (CA)

(72) Inventor: Stephen Craig Horne, Cochrane (CA)

(73) Assignee: ENCANA CORPORATION, Calgary (CA)

( * ) Notice: Subject to any disclaimer, the term of this patent is extended or adjusted under 35 U.S.C. 154(b) by 0 days.

(21) Appl. No.: 15/353,603

(22) Filed: Nov. 16, 2016

(65) Prior Publication Data

US 2017/0211877 A1 Jul. 27, 2017

Related U.S. Application Data

(60) Provisional application No. 62/286,132, filed on Jan. 22, 2016.

(51) Int. Cl.
*F25J 3/02* (2006.01)
*F25J 1/00* (2006.01)

(52) U.S. Cl.
CPC ..... *F25J 3/0209* (2013.01); *F25J 1/0022* (2013.01); *F25J 3/0219* (2013.01); *F25J 3/0223* (2013.01); *F25J 3/0233* (2013.01); *F25J 3/0238* (2013.01); *F25J 3/0242* (2013.01); *F25J 3/0247* (2013.01); *F25J 3/0295* (2013.01); *F25J 2200/02* (2013.01); *F25J 2205/60* (2013.01); *F25J 2210/04* (2013.01)

(58) Field of Classification Search
CPC .... F25J 3/0209; F25J 2200/10; F25J 2200/04; F25J 3/0238; F25J 3/0233; F25J 3/0242; F25J 3/0247
See application file for complete search history.

(56) References Cited

U.S. PATENT DOCUMENTS

| | | | |
|---|---|---|---|
| 4,115,086 | A | 9/1978 | Jordan et al. |
| 4,511,381 | A | 4/1985 | Mehra |
| 4,653,698 | A | 3/1987 | Cooper et al. |
| 4,673,488 | A | 6/1987 | Turner et al. |
| 5,462,583 | A | 10/1995 | Wood et al. |
| 5,546,764 | A | 8/1996 | Mehra |

(Continued)

FOREIGN PATENT DOCUMENTS

| | | |
|---|---|---|
| WO | WO 2004/069384 A1 | 8/2004 |
| WO | WO 2013/056267 A1 | 4/2013 |

OTHER PUBLICATIONS

Gas Processors Suppliers Association, Hydrocarbon Recovery, Gas Processors Suppliers Association Engineering Data Book, 2012, Section 16, Gas Suppliers Association, Tulsa, Oklahoma, USA.*

*Primary Examiner* — Keith M Raymond
*Assistant Examiner* — Nael N Babaa
(74) *Attorney, Agent, or Firm* — Bennett Jones LLP

(57) ABSTRACT

A process for separating a mixed or raw gas feed to produce a dry gas product and a hydrocarbon liquid product is provided. The process comprises scrubbing heavier hydrocarbon components from the gas feed to produce a lighter ends gas stream and a heavier ends liquid stream; cooling the lighter ends gas stream and separating the cooled lighter ends gas stream into a cold liquid stream and the dry gas product; and using the cold liquid stream to assist in scrubbing the heavier hydrocarbon components from the gas feed.

19 Claims, 7 Drawing Sheets

(56) References Cited

U.S. PATENT DOCUMENTS

| | | | | |
|---|---|---|---|---|
| 6,453,698 | B2 | 9/2002 | Jain et al. | |
| 6,658,893 | B1 | 12/2003 | Mealey | |
| 6,662,589 | B1 * | 12/2003 | Roberts | F25J 1/0241 62/425 |
| 6,712,880 | B2 | 3/2004 | Foglietta et al. | |
| 7,875,759 | B2 | 1/2011 | Shamsudin | |
| 8,794,030 | B2 | 8/2014 | Martinez et al. | |
| 2004/0148964 | A1 | 8/2004 | Patel et al. | |
| 2005/0229634 | A1 | 10/2005 | Huebel et al. | |
| 2006/0005573 | A1 * | 1/2006 | Stockmann | F25J 3/0209 62/620 |
| 2013/0305777 | A1 | 11/2013 | Prim et al. | |
| 2014/0303416 | A1 | 10/2014 | Keusenkothen et al. | |
| 2015/0073194 | A1 | 3/2015 | Hudson et al. | |
| 2015/0073196 | A1 | 3/2015 | Miller et al. | |
| 2016/0216030 | A1 * | 7/2016 | Truong | F25J 3/0214 |

* cited by examiner

Figure 3 [Retrofit]

PROCESS AND APPARATUS FOR PROCESSING A HYDROCARBON GAS STREAM

FIELD OF THE INVENTION

The present invention is directed to a process and apparatus for processing a mixed hydrocarbon gas stream such as natural gas, refinery gas, and synthetic gas streams. More particularly, the present process and apparatus provide an enhanced and sharper separation of hydrocarbon mid-components (i.e., $C_3$ and/or $C_4$ hydrocarbons) from a mixed hydrocarbon gas stream. The present invention further provides the capability to direct a desired portion of the mid-components to either a gaseous product comprising the majority of $C_1$, $C_2$, hydrocarbons or a liquid product comprising the majority of $C_5$ and $C_6$+ hydrocarbons, or a chosen amount to both gas and liquid products in order to maximize profitability at any time.

BACKGROUND OF THE INVENTION

Raw or mixed hydrocarbon gas consists primarily of methane ($CH_4$) but also includes heavier gaseous hydrocarbons such as ethane ($C_2H_6$), propane ($C_3H_8$), butanes ($C_4H_{10}$), pentanes ($C_5H_{12}$), higher molecular weight hydrocarbons ($C_6$+), and other hydrocarbon species and non-hydrocarbons associated with the raw gas source.

The relative amount of the heavier gaseous hydrocarbons, or richness, can be expressed in terms of gallons per mcf (thousand cubic feet), abbreviated as GPM. In this embodiment, GPM includes all hydrocarbon components heavier than methane and represents the total volume, in liquid gallons, contained in one thousand cubic feet of a particular gas at standard conditions.

The raw gas must be purified to produce a gas product that meets the quality standards specified by a particular gas transmission pipeline ("sales gas"). Typically, one of the objectives of gas processing is to remove liquefiable hydrocarbons commonly referred to as hydrocarbon gas liquids (HGL) comprised of propane, butanes, pentanes and higher molecular weight $C_{6+}$ hydrocarbons to meet the pipeline gas quality specification desired. A second objective is often then to remove further HGL (deeper cut, e.g., incremental $C_{3+}$ and perhaps even ethane, C2) for economic gain. If the raw gas stream contains objectionable quantities of non-hydrocarbon compounds such as sulphur compounds or carbon dioxide, these are typically removed by pre-treatment processes not shown or discussed here. Similarly, excess water vapor in the raw gas stream is removed through dehydration.

A conventional approach to removing the HGL is to use the straight refrigeration process as described in the Gas Processors Suppliers Association Engineering Data Book, Chapter 16, 13$^{th}$ Edition. While there are several configurations known in the art for the straight refrigeration process, FIG. 1 (Prior Art) depicts a configuration that is commonly used in the industry and is hereinafter referred to as "conventional refrigeration process". In the conventional refrigeration process shown in FIG. 1, a rich gas feed (stream 110) is combined with recycle gas (stream 127) to produce stream 111. Stream 111 is then separated into two steams, stream 112 and stream 114, where stream 114 enters a gas-to-liquid heat exchanger 101 and stream 112 enters a gas-to-gas heat exchanger 102. The heat exchangers reduce the temperature of the gas streams 112 and 114, which streams exit as cooled gas stream 113 and cooled gas stream 115, respectively.

Streams 113 and 115 are then combined and combined cool gas stream (stream 116) is further chilled in a second heat exchanger (gas chiller 103), which uses mechanical refrigeration, typically using propane as the refrigerant, but could use any refrigerant type, and could include using Joule-Thompson expansion cooling. The desired temperature of the cold gas 117 produced is dependent on the raw gas composition, the pressure of the raw gas stream, the gas quality specification desired, and the economics of recovering additional liquids.

The cold gas 117 is sent to a cold gas separator (cold separator 105), which is also referred to in the literature as a low temperature separator or LTS, where the condensed liquids 122 are separated from gas. The residual gas stream 118 from the cold separator 105 is returned to the gas-to-gas heat exchanger 102, and is warmed by the incoming raw gas stream 112. The warmed residual gas 119 is dry relative to the rich gas feed stream 110 and is often intended to be conveyed to the gas transmission pipeline for sale (dry sales gas 120).

Liquids 122 from the cold separator 105 are warmed in the gas-to-liquid exchanger 101 and the warmed liquids 124 are then expanded through adjustable valve 106 which functions to hold a constant liquid level in the cold separator 105 and reduce the liquid stream pressure (stream 125) before stream 125 enters the fractionation column or tower 108. Heat exchangers 101 and 102 reduce the energy requirement in gas chiller 103, by utilizing the energy already expended to chill the cold gas stream and transferring energy from warm to cold streams.

The fractionation tower 108 comprises a reboiler 156, which provides heat and generates vapors to drive the distillation or fractionation process. The fractionation tower 108 distills the co-absorbed light components (primarily $C_1$, $C_2$, and sometimes $C_3$, and $C_4$ hydrocarbons) from the liquid stream to meet the HGL quality specifications of a liquids transporter and downstream refinery or fractionation facility. The fractionation tower may further comprises a reflux condenser (not shown) to improve separation of the light hydrocarbon components from the heavier ends liquid stream.

However, the composition of the HGL from the conventional refrigeration process is somewhat inflexible as discussed later, The overhead gas stream 126 from the fractionation tower 108 is then compressed in overhead compressor 109 to produce recycle gas 127. Recycle gas 127 is recycled by combining with the rich gas feed 110 and reprocessed. The bottom liquids product 130 contains the HGL extracted from the gas stream. In one alternative, the overhead compressor gas 109 can be added as gas 128 to residual gas 119 to produce dry sales gas 120.

In the conventional refrigeration process, the "mid-components", which are defined herein as $C_3$ and $C_4$ hydrocarbons, are extracted from the rich gas feed as liquid product and are therefore found in the HGL product. However, there may be times when market demand and product pricing does not economically support the extraction of the propane and butane from the raw gas, and, therefore, rejection of these constituents from the HGL product to the gas product is desired. In other words, there is more value for these mid-components to remain in the gas stream rather than be recovered as HGL product, provided gas transmission pipeline specifications are met.

There may also be times where the extraction of the heavier hydrocarbons is desired close to the source of the raw gas, and the extraction of the mid-components is desired at an alternate downstream gas processing plant, generally distant from the source and which feedstock often comprises an aggregation of several residue gas streams, to achieve economies of scale and close proximity to consumer markets.

To maintain these mid-components in the residue gas steam in a conventional refrigeration process, conventional practice has been to: adjust the temperature in gas chiller 103 to a higher temperature so as to reduce the amount of these constituents condensed and separated in cold separator 105 as liquid stream 122; and/or adjust the operating conditions in the fractionation tower 108 and reboiler 156 in order to reject the co-absorbed mid components into stream 126 and recycle stream 127 back into the rich gas feed stream 110; and in very rich raw gas feed streams, conventional practice is to re-direct the fractionation overhead gas stream 127 from combining with the raw gas feed stream 110, to combining with the residue gas stream 119, via stream 128, to form dry Sales Gas 120.

However, the above practices to maintain mid-components in the dry sales gas stream 120 can result in low recoveries of the constituents that are desirable in the HGL product stream 130. In other words, economic value is lost because a portion of the heavier hydrocarbons such as $C_{6+}$, pentanes, and sometimes butanes remain in the dry sales gas stream 120. Therefore, there is a need in the industry for a process and apparatus that is capable of customizing the amount of propane and butane retained in a sales gas product from a raw gas stream without compromising the recovery of valuable heavy hydrocarbons such as $C_5$ and $C_6$+ components (HGL products) from the raw gas stream.

SUMMARY OF THE INVENTION

The present invention is directed to a process and apparatus for purifying a mixed hydrocarbon gas stream by removing hydrocarbon gas liquids (HGL) therefrom to produce a gas product that meets the sales gas quality standards intended. The present invention may be used to purify a variety of gases such as natural gas, refinery gas, and synthetic gas streams. In particular, the present invention is directed to a process and apparatus with the flexibility to direct mid-component hydrocarbons (i.e., $C_3$ and $C_4$ hydrocarbons) contained in a mixed hydrocarbon gas stream ($C_1$ to $C_{6+}$) to produce a gas product comprising the majority of $C_1$ and $C_2$ components and having a desired proportion of mid-components (i.e., $C_3$ and $C_4$ hydrocarbons) and a liquid product comprising the majority of $C_5$ and $C_6$+ hydrocarbons and having a desired proportion of mid-components. In other words, the present invention provides the versatility to produce either: a $C_{3+}$ rich HGL stream, with a very high percentage recovery of the $C_{4+}$ components; or a high recovery $C_{4+}$ HGL stream; or strictly a very high recovery $C_{5+}$ HGL stream; with all other components remaining in the sales gas stream.

In one aspect, the present invention provides a process and apparatus that enhances hydrocarbon gas liquids (HGL) recovery from mixed hydrocarbon gas streams when compared to a conventional refrigeration process. More particularly, a process and apparatus is provided which includes the addition of an absorber between a gas/gas heat exchanger and a gas chiller of a conventional refrigeration process. Cold separator liquids are pumped to the top of the absorber as a rectifying solution. The enhancement results in very high recovery of heavy hydrocarbons such as $C_5$+ components from the gas stream, with the potential to direct a desired proportion of mid-components to the gas product or the HGL product. Furthermore, the enhancement often results in lower utility loads for very rich gas streams as compared to the conventional refrigeration process.

Thus, in one aspect, a process is provided for separating a mixed or raw gas feed such as natural gas, refinery gas and synthetic gas, the gas feed containing methane, $C_2$ components, $C_3$ components, $C_4$ components and heavier hydrocarbon components ($C_5$+), into a dry gas product containing a portion of $C_3$ and $C_4$ components, comprising:

- scrubbing heavier hydrocarbon components from the gas feed to produce a lighter ends gas stream and a heavier ends liquid stream;
- cooling the lighter ends gas stream and separating the lighter ends gas stream into a cold liquid stream and the dry gas product; and
- using the cold liquid stream to assist in scrubbing the heavier hydrocarbon components from the cooled gas feed.

In one embodiment, the process includes cooling the gas feed prior to scrubbing to reduce energy consumption required for cooling the lighter ends gas stream. In another embodiment, the process further comprises flash distillation and/or fractionating the heavier ends liquid stream to form a hydrocarbon gas liquid product and an overhead gas stream. In one embodiment, the overhead gas stream is compressed and the compressed gas stream is combined with the mixed or raw gas feed. In one embodiment, the hydrocarbon gas liquid product comprises the majority of C5+ hydrocarbon components from the mixed or raw gas feed.

In another aspect, an apparatus is provided for separating a mixed or raw gas feed such as natural gas, refinery gas and synthetic gas, the gas feed containing methane, $C_2$ components, $C_3$ components, $C_4$ components and heavier hydrocarbon components ($C_5$+) into a dry gas product containing a portion of $C_3$ and $C_4$ components, comprising:

- an absorber for receiving the gas feed and scrubbing heavier hydrocarbon components from the gas feed to form a lighter ends gas stream and a heavier ends liquid stream;
- a first cooling device for receiving the lighter ends gas stream and cooling the lighter ends gas stream; and
- a cold separator for receiving the cooled lighter ends gas stream and removing condensed liquids from the cooled lighter ends gas stream to form the dry gas product.

In one embodiment, the apparatus further comprises at least one second cooling device for cooling the gas feed prior to sending it to the absorber. In another embodiment, the apparatus further comprises a feed pump for pumping the condensed liquids to the absorber to assist in scrubbing heavier hydrocarbon components from the gas feed. In another embodiment, the apparatus further comprises a flash separator and/or a fractionation tower for receiving the heavier ends liquid stream from the absorber and fractionating the heavier ends liquid stream to form hydrocarbon gas liquids and an overhead gas stream, In another embodiment, the apparatus further comprises an overhead gas compressor to increase the pressure of the overhead gas stream to form a recycle gas stream for reprocessing. In one embodiment, the recycle gas stream is added to the mixed or raw gas feed prior to further processing.

In another aspect, an improved apparatus is provided for separating a mixed or raw gas feed including natural gas, refinery gas, and synthetic gas, the gas feed containing methane, $C_2$ components, $C_3$ components, $C_4$ components and heavier hydrocarbon components ($C_5$+), into a dry gas product containing a portion of $C_3$ and $C_4$ components, said apparatus comprising in series at least one heat exchanger, a gas chiller, a cold separator and a gas/liquid fractionator, said improvement comprising:

an absorber operably connected to the at least one heat exchanger for receiving a cooled gas feed from the at least one heat exchanger and scrubbing heavier hydrocarbon components from the cooled gas feed in the absorber to form a lighter ends gas stream and a heavier ends liquid stream prior to sending the lighter ends gas stream to the gas chiller.

Other features will become apparent from the following detailed description. It should be understood, however, that the detailed description and the specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the following figures. It is understood that the drawings provided herein are for illustration purposes only and are not necessarily drawn to scale.

DESCRIPTION OF THE PREFERRED EMBODIMENT

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The purpose of gas processing such as natural gas processing is to convert raw natural gas into sales gas and HGL which can be delivered to end user markets, In other words, gas processing conditions gas to commercial specifications, e.g., hydrocarbon dew point (HCDP), water content, heating value, and other qualities as specified by a particular gas transmission or distribution company. Further, gas processing allows for the recovery of higher value liquefied products such as $C_2$, $C_3$, $C_4$, and $C_5$+ hydrocarbons, processed by one or more fractionation steps to meet commercial specifications such as hydrocarbon component content, vapor pressure, and density. As used herein "rich gas" means a gas which contains heavier hydrocarbons and is typically between temperatures of 30° F. and 120° F., and is typically provided at pressures between 200 Psig and 1000 Psig.

Figure 2:
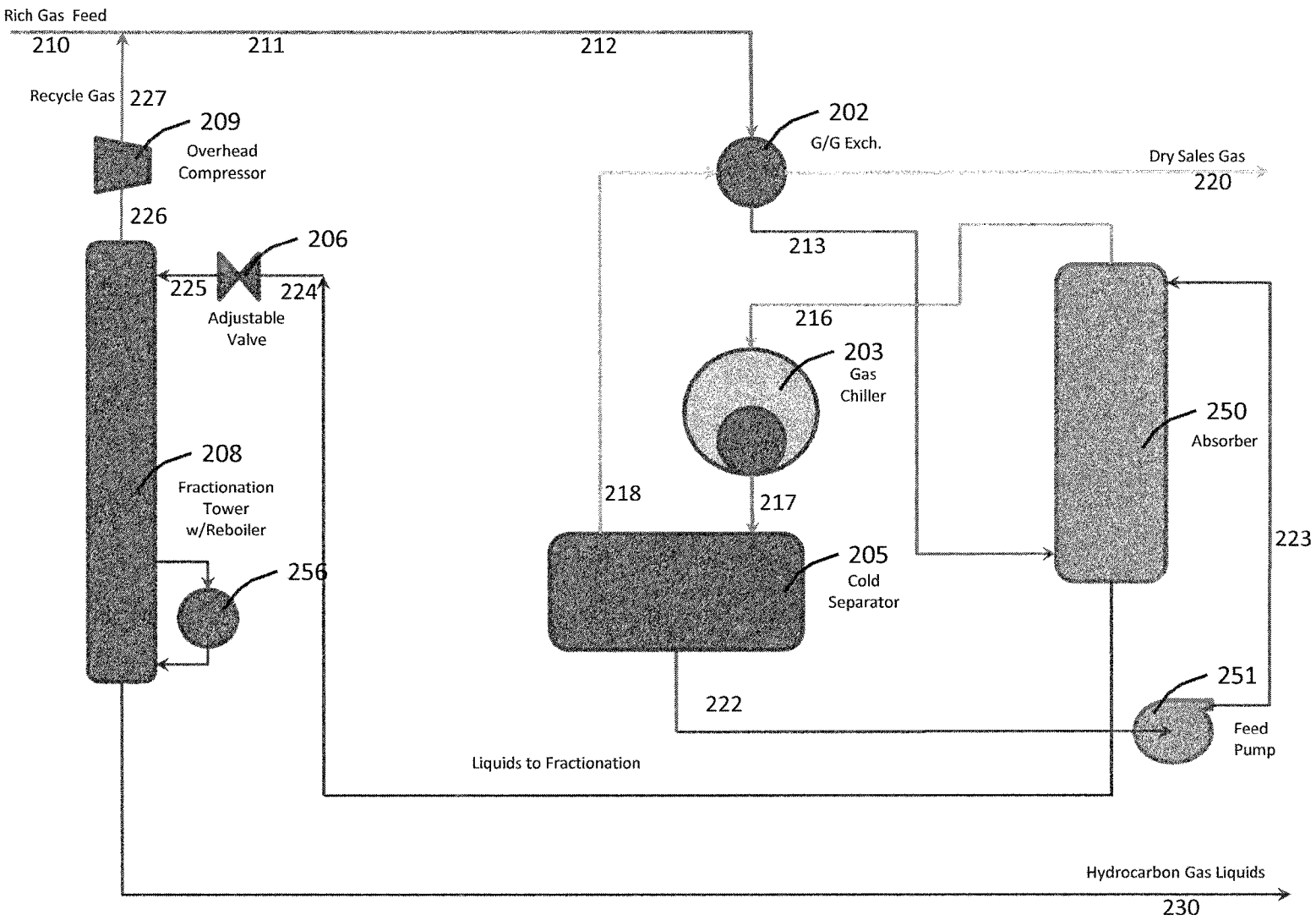
FIG. 2 is a schematic depiction of one embodiment of the process and apparatus of the present invention.

FIG. 2 shows one embodiment of a hydrocarbon gas processing plant of the present invention. In particular, rich gas feed 210 is combined with recycle gas (stream 227) to produce stream 211, which stream 211 can be further processed in at least one heat exchanger. In the embodiment shown in FIG. 2, stream 211 is only fed to a single heat exchanger as stream 212. Stream 212 is fed into a gas/gas heat exchanger 202 and is cooled in heat exchanger 202 by heat exchange with cool stream 218. It is understood, however, that stream 212 can be cooled in one or more of any cooling device, for example, such as a cooling tower, evaporative cooler, water chiller, gas chiller, waste heat exchanger, Joule-Thompson expansion valve, and the like.

Figure 1:
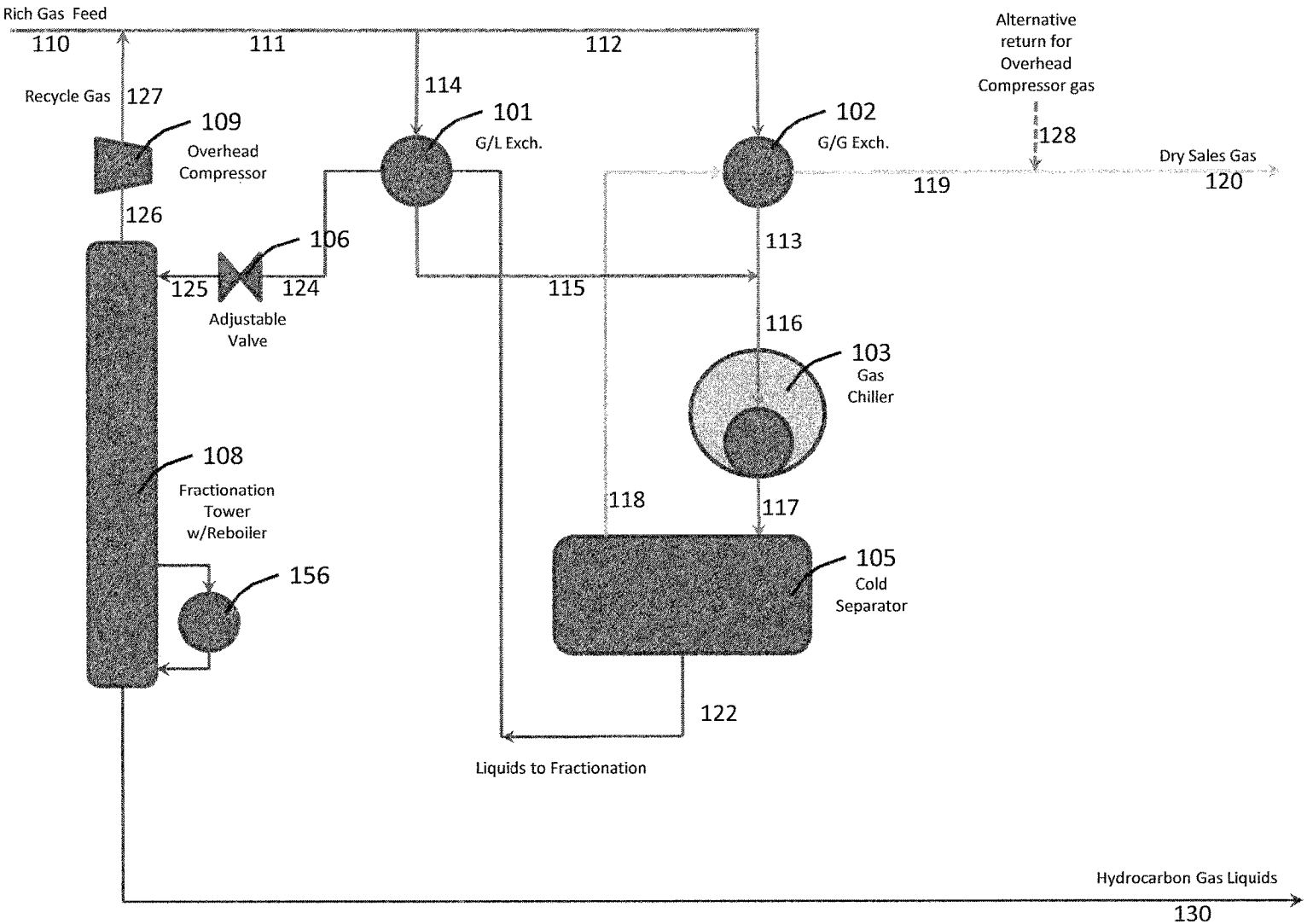
Figure 1 (Prior Art)
FIG. 1 is a schematic depiction of a conventional refrigeration process and apparatus of the prior art.

However, unlike in the conventional refrigeration process shown in FIG. 1 (Prior Art), cooled gas stream 213 is directed to the bottom of heavy ends absorber tower 250, where the heavy ends are scrubbed out. Thus, in this embodiment, the flow of cooled gas stream 213 does not go to gas chiller 203 (as is the case in the conventional refrigeration process) and, instead, is directed to absorber 250. The absorber may be filled with suitable packing or trays. In absorber 250, the heavy ends are scrubbed out and are removed from the bottom of absorber 250 as liquids 224. The remaining scrubbed gas stream 216 is removed from the top of the absorber 250 and directed into gas chiller 203 for further cooling. It is understood, however, that stream 216 can be cooled in one or more of any cooling device, for example, such as a Joule-Thompson expansion valve, gas chiller, waste heat/cold exchanger, and the like. Gas chiller 203 commonly uses propane as the refrigerant but other refrigerants known in the art can also be used. Temperatures in the chiller typically range between −40° F. and 25° F.

The cold gas 217 is then fed to a cold gas separator 205, where the condensed liquids 222 are separated from the gas stream. The dry residue gas stream 218 that is produced in cold gas separator 205 is directed to gas/gas heat exchanger 202 and is used to cool gas stream 212. It is understood that heat exchanger 202 aids in reducing the energy requirement in gas chiller 203, and elevates the temperature of the sales gas stream 220 for further processing or transmission. The warmed sales gas 220 is dry relative to the rich gas feed stream 210, and is often intended to be conveyed to the gas transmission pipeline for sale (dry sales gas 220). It is understood, however, that warming the sales gas stream may not be necessary if the sales gas stream is intended to go to further cryogenic processing, for example, ethane production or liquefied natural gas (LNG) production.

Condensed liquids 222 produced in cold separator 205 are then pumped via feed pump 251 and returned to the top of absorber 250 as liquid stream 223. The counter-current flow of cooled gas stream 213 and liquid stream 223 allow the two streams to contact one another in the absorber 250 and, thus, provides multiple stages of contact to alter the composition of both the gas stream produced (gas stream 216) and the liquid stream 224. In particular, liquid stream 224 will contain fewer light hydrocarbons (e.g., $C_1$ and $C_2$ hydrocarbons) than in stream 223 and additional heavy hydrocarbons (e.g., $C_5$+ hydrocarbons), which have been removed (scrubbed) from the cooled gas stream 213. Hence, the heavy hydrocarbons are scrubbed from the cooled gas stream 213 and the light hydrocarbons are stripped from light liquid stream 223. Thus, the absorber 250, gas chiller 203 and cold separator 205, in combination, operate as a rectifier column, reducing the light end components and increasing the heavier components in the absorber 250 bottom liquid product stream 224, thereby providing sharp separation between light key components and heavy key components.

The liquid stream 224 is removed from the bottom of absorber 250 and flash expanded through expansion (adjustable) valve 206 to the operating pressure of fractionation tower 208. During expansion a portion of the stream is vaporized, resulting in cooling of the total stream. The expanded stream 225 leaving expansion valve 206 is sent to fractionating tower 208 to distill the light ends (e.g. methane, ethane and propane) from the liquid, resulting in heavy liquid product 230 and light ends gaseous stream 226. The fractionation tower 208 comprises a reboiler 256, which provides heat and generates vapors to drive the distillation or fractionation process. The fractionation tower pressure typically ranges between 80 Psig to 350 Psig and reboiler temperatures range may from 140° F. to 320° F. The fractionation tower provides the versatility and ability to reject the desired proportion of mid-components from the heavy liquid product stream 225, back into the raw gas as the overhead gas stream 226. The selected operating pressure and temperature is dependent in part on what portions of mid-components are to be rejected, and the composition of the heavy liquid stream. In one embodiment, the fractionation tower 208 may further comprises a reflux condenser (not shown) to improve separation of the mid-components from the heavier ends liquid stream.

The overhead gas stream 226 from the fractionation tower 208 is then compressed in overhead compressor 209 to produce recycle gas 227. Recycle gas 227 is recycled by combining with the rich gas feed 210 and reprocessed. The bottom heavy liquids product 230 contains the HGL extracted from the gas stream.

In comparison to the conventional refrigeration process shown in FIG. 1, the HGL 230 produced by the process shown in FIG. 2 of the present invention significantly increases the volume of $C_5$ recovered from rich gas streams having greater than 2 GPM, and significantly improves the propane rejection to the residue stream (sales gas). For example, with certain rich gas streams, i-pentane recovery in the HGL may be increased from 84.74% to 99.52%. Further, $C_3$ rejection from HGL 230 may increase from 76.60% to 97.22%. Consequently, the dry sales gas 220 can be tailored to contain more propane and butane, thereby maximizing value from the raw gas stream for specific economic conditions.

Figure 3:
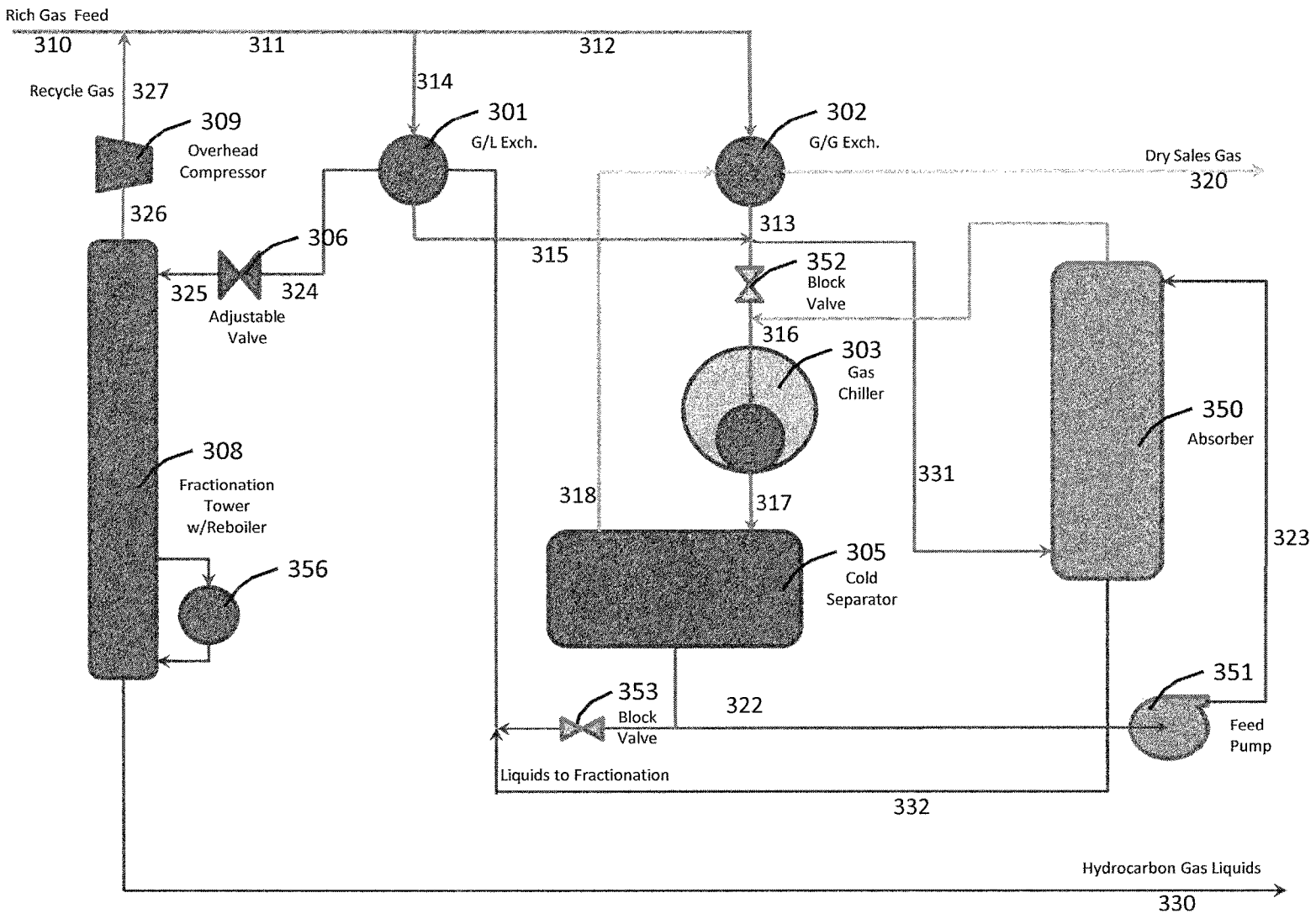
FIG. 3 is a schematic depiction of another embodiment of the process and apparatus of the present invention as an addition or retrofit to an existing conventional refrigeration process.

In one embodiment, the conventional refrigeration process equipment shown in FIG. 1 can be retrofitted with an absorber to achieve similar benefits as realized when practicing the process shown in FIG. 2 and described above. With reference now to FIG. 3, in this embodiment, rich gas feed (stream 310) is combined with recycle gas (stream 327) to produce stream 311. Stream 311 is then separated into two steams, stream 312 and stream 314, where stream 314 enters a gas-to-liquid heat exchanger 301 and stream 312 enters a gas-to-gas heat exchanger 302. The heat exchangers reduce the temperature of the gas streams 312 and 314, which streams exit as cooled gas stream 315 and cooled gas stream 313, respectively. Streams 313 and 315 are then combined and, when block valve 352 is in the closed position, the combined cool gas stream (stream 331) is directed to the bottom of heavy ends absorber tower 350, where the heavy ends are scrubbed out. The flow of both cooled gas stream 313 and cooled gas stream 315 is controlled by block valve 352. In absorber 350, the heavy ends are scrubbed out and are removed from the bottom of absorber 350 as liquids 332. The remaining scrubbed gas stream 316 is removed from the top of the absorber 350 and directed into gas chiller 303 for further cooling. It is understood, however, that stream 316 can be cooled in one or more of any cooling device, for example, such as a Joule-Thompson expansion valve, gas chiller, waste heat/cold exchanger, and the like. Gas chiller 303 commonly uses propane as the refrigerant but other refrigerants known in the art can also be used. Temperatures in the chiller typically range between −40° F. and 25° F.

The cold gas 317 is then fed to a cold gas separator 305, where the condensed liquids 322 are separated from the gas stream. The dry residue gas stream 318 that is produced in cold gas separator 305 is directed to gas/gas heat exchanger 302 and is used to cool gas stream 312. It is understood that heat exchangers 301 and 302 aid in reducing the energy requirement in gas chiller 303, and elevate the temperature of the sales gas stream 320 for further processing or transmission. The warmed sales gas 320 is dry relative to the rich gas feed stream 310, and is often intended to be conveyed to the gas transmission pipeline for sale (dry sales gas 320). It is understood, however, that warming the sales gas stream may not be necessary if the sales gas stream is intended to go to further cryogenic processing, for example, ethane production or liquefied natural gas (LNG) production.

When block valve 353 is in the closed position, condensed liquids 322 produced in cold separator 305 are pumped via feed pump 351 and returned to the top of absorber 350 as liquid stream 323. The counter-current flow of combined cool gas stream 331 and liquid stream 323 allow the two streams to contact one another in the absorber 350 and, thus, provides multiple stages of contact to alter the composition of both the gas stream produced (gas stream 316) and the liquid stream 332. In particular, liquid stream 332 will contain fewer light hydrocarbons (e.g., $C_1$ and $C_2$ hydrocarbons) than in stream 323 and more heavy hydrocarbons (e.g., $C_5$+ hydrocarbons), which have been removed (scrubbed) from the combined cool gas stream 331. Hence, the heavy hydrocarbons are scrubbed from the combined cool gas stream 331 and the light hydrocarbons are stripped from the liquid. Thus, in this embodiment, the absorber 350, gas chiller 303 and cold separator 305, in combination, also operate as a rectifier column, reducing the light end components and increasing the heavier components in the absorber 350 bottom liquid product stream 332, thereby providing sharp separation between light key components and heavy key components.

The liquid stream 332 is removed from the bottom of absorber 350 and passes into Gas/Liquid heat exchanger 301, being warmed by the raw gas stream 314. Stream 324 exits Gas/Liquid heat exchanger 301 and is flash expanded through expansion (adjustable) valve 306 to the operating pressure of fractionation tower 308. During expansion a portion of the stream is vaporized, resulting in cooling of the total stream. The expanded stream 325 leaving expansion valve 306 is sent to fractionating tower 308 to distill the light ends (e.g. methane, ethane and propane) from the liquid, resulting in heavy liquid product 330 and light ends gaseous stream 326. The fractionation tower 308 comprises a reboiler 356, which provides heat and generates vapors to drive the distillation or fractionation process. In one embodiment, the fractionation tower 308 may further comprises a reflux condenser (not shown) to improve separation of the light ends (e.g. methane, ethane and propane) from the heavier ends liquid stream.

The overhead gas stream 326 from the fractionation tower 308 is then compressed in overhead compressor 309 to produce recycle gas 327. Recycle gas 327 is recycled by combining with the rich gas feed 310 and reprocessed. The bottom heavy liquids product 330 contains the HGL extracted from the gas stream.

Thus, in the embodiment shown in FIG. 3, the hydrocarbon gas processing plant can operate either as a conventional refrigeration processing plant or as a hydrocarbon gas processing plant of the present invention. When blocking valves 352, 353 are in the closed position, the plant operates as a hydrocarbon gas processing plant of the present invention. However, when block valves 352, 353 are in the open position, the plant will operate as a conventional refrigeration processing plant. The present invention is adaptable to existing gas processing plants already employing the prior art, or a version thereof.

EXAMPLE 1

A comparison of the composition of the sales gas produced from the conventional refrigeration process (FIG. 1 (Prior Art)) and the sales gas of the present invention (FIG. 2) when targeting a sales gas hydrocarbon dew point (HCDP) of 23° F. at 800 Psig is shown in Table 1 below.

TABLE 1

| Component - mol fraction | — Rich Gas Feed | Conventional Sales Gas | Enhanced Sales Gas |
|---|---|---|---|
| Helium | 0.000993 | 0.001043 | 0.001029 |
| Nitrogen | 0.008428 | 0.008856 | 0.008737 |
| CO2 | 0.007692 | 0.008044 | 0.007973 |
| H2S | 0.000002 | 0.000002 | 0.000002 |
| Methane | 0.721123 | 0.757708 | 0.747454 |
| Ethane | 0.144403 | 0.151728 | 0.149624 |
| Propane | 0.073780 | 0.059381 | 0.073939 |
| i-Butane | 0.011130 | 0.004904 | 0.005582 |
| n-Butane | 0.021026 | 0.007102 | 0.005637 |
| i-Pentane | 0.004011 | 0.000643 | 0.000021 |
| n-Pentane | 0.003884 | 0.000476 | 0.000004 |
| Hexane | 0.001685 | 0.000072 | 0.000000 |
| Heptane | 0.001176 | 0.000034 | 0.000000 |
| Octane | 0.000574 | 0.000008 | 0.000000 |
| Nonane | 0.000078 | 0.000000 | 0.000000 |
| Decane+ | 0.000014 | 0.000000 | 0.000000 |
| | 1.000000 | 1.000000 | 1.000000 |

It can be seen from Table 1 that when using the present invention (Enhanced), much more propane and i-butane report to the sales gas and much less $C_5$+ hydrocarbons (i.e., i-pentane, n-pentane, n-hexane, n-heptane, n-octane, n-nonane and n-decane) are present therein when compared to the sales gas of the Prior Art (Conventional). Further, essentially no heavy hydrocarbons ($C_5$+ components) were found in the sales gas. Hence, the enhancement of the present invention results in high recovery (removal) of heavy hydrocarbons ($C_5$+ components) from the rich gas feed and more rejection of lighter hydrocarbons such as $C_3$ and i-$C_4$ to the sales gas product. Yet, both conventional and enhanced sales gas streams achieve the same HCDP.

Thus, under prescribed conditions, the present invention (Enhanced) produces a more valuable HGL stream per unit of volume than when using the Prior Art conventional refrigeration process. This can be seen more clearly in Table 2.

TABLE 2

| Process Parameter | Units | Conventional | Enhanced | |
|---|---|---|---|---|
| Rich Gas Feed Rate | MMscfd | 26.3 | 26.3 | |
| Sales Gas HCDP | ° F. at 800 Psig | Target 23° | Target 23° | |
| Cold Sep. Temperature | ° F. | −4.0 | 11.1 | |
| Cold Sep. Pressure | Psig | 490 | 480 | |
| Chiller duty | MMbtu/hr | 3.09 | 2.46 | |
| Refridge Compressor Load | HP | 788 | 569 | −27.8% |
| HC liq to Fractionator | bbl/day | 2140 | 1874 | |
| Fractionator Pressure | Psig | 270 | 270 | |
| Fractionator Ovhd. Vol. | MMscfd | 2.49 | 1.93 | |
| Overhead Compressor Load | HP | 84 | 65 | −22.6% |
| Fractionator Reboiler Temperature | ° F. | 204 | 252 | |
| Fractionator Reboiler Duty | MMbtu/hr | 1.89 | 2.04 | 7.9% |
| HGL Product Volume | bbl/day | 942 | 729 | |
| Sales Gas Volume | MMscfd | 25.02 | 25.37 | 1.4% |
| Higher Heating Value | btu/scf | 1219 | 1234 | 1.2% |
| Propane Recovery | % of Feed | 23.40 | 2.78 | |
| i-Butane Recovery | % of Feed | 58.07 | 51.68 | |
| n-Butane Recovery | % of Feed | 67.85 | 74.55 | |
| i-Pentane Recovery | % of Feed | 84.74 | 99.52 | |
| n-Pentane Recovery | % of Feed | 88.33 | 99.91 | |
| Hexane Recovery | % of Feed | 95.93 | 100.00 | |
| Heptane Recovery | % of Feed | 98.55 | 100.00 | |
| Propane Yield | bbl/day | 293.3 | 38.7 | |
| Butanes Yield | bbl/day | 408.4 | 422.4 | |
| C5+ Yield | bbl/day | 240.7 | 267.8 | |
| HGL-Product:Feed Ratio | bbl/MMscf | 37.68 | 29.14 | |

In particular, when targeting a sales gas HCDP of 23° F. at 800 Psig, it can be seen from Table 2 that the HGL stream produced using the Conventional process yields 293.3 bbl/d propane, 408.4 bbl/d of butanes and 240.7 bbl/d of pentanes+ ($C_{5+}$). On the other hand, when using the Enhanced process of the present invention, only 38.7 bbl/d of propane are yielded in the HGL stream. This results in a marginally higher sales gas volume with slightly higher heating value due to more propane ($C_3$) being directed to the sales gas stream, which may be favorable for specific economic conditions. Further, 267.8 bbl/d of pentanes+ ($C_{5+}$) are yielded in the HGL stream (as compared to 240.7 bbl/d in Conventional), resulting in better recovery of heavy hydrocarbons in the HGL product.

Furthermore, Table 2 shows that when using the Enhanced process of the present invention the refrigeration compressor load decreases 27.8%, and the overhead compressor load decreases 22.6%, resulting in significantly lower utility requirements and slightly smaller equipment having lower capital costs, when comparing to the conventional refrigeration process (Prior Art). Further, the cold separator can be operated at a much higher temperature, i.e., 11.1° F. versus −4.0° F. with the conventional refrigeration process.

Table 3 below further illustrates the difference in intermediate liquid streams compositions generated in the conventional refrigeration of the prior art as compared to the present invention (Enhanced). Specifically, in the present invention, stream 222, which is the liquid stream produced in the cold separator 205, contains much less $C_{5+}$ (heavy ends) as compared to stream 122 in the conventional refrigeration process. This is because the $C_{5+}$ (heavy ends) have already been stripped out of the raw gas in the absorber 250, and, thus, a much lighter liquid product is produced in cold separator 205 to send to the absorber 250 as a scrubbing fluid.

Thus, liquid streams 224, 225, which are produced in the absorber 250 and fed to the fractionation tower 208, respectively, will contain higher volume flows of $C_4$ (and $C_{5+}$ heavier components) and much less $C_3$ and lighter components when compared to liquid streams 122, 124 and 125 of the conventional art, which streams are produced in the cold separator 105, cooled in gas/liquid exchanger 101, and fed into fractionation tower 108, respectively.

TABLE 3

| Component - bbl/d | Stream 122 & 125 Conventional Cold Sep. Liquid & Liq. To Frac. | Stream 222 Enhanced Cold Sep. Liquid | Stream 225 Enhanced Liq. To Frac. |
|---|---|---|---|
| Helium | 0 | 0 | 0 |
| Nitrogen | 1 | 1 | 1 |
| CO2 | 9 | 6 | 4 |
| H2S | 0 | 0 | 0 |
| Methane | 358 | 234 | 190 |
| Ethane | 555 | 396 | 286 |
| Propane | 670 | 693 | 531 |
| i-Butane | 168 | 147 | 177 |
| n-Butane | 333 | 198 | 410 |
| i-Pentane | 84 | 2 | 103 |
| n-Pentane | 82 | 0 | 97 |
| Hexane | 42 | 0 | 45 |
| Heptane | 29 | 0 | 30 |
| Octane | 7 | 0 | 7 |
| Nonane | 11 | 0 | 11 |
| Decane + | 1 | 0 | 1 |
| | 2349 | 1678 | 1892 |

EXAMPLE 2

Table 4 below shows the flexibility of the present invention using the same rich gas feed as in Example 1. In this example, the objective is to obtain the maximum liquids possible, including propane and butanes, while the refrigeration compressor load is limited to 1151 HP for both the Conventional and Enhanced process.

TABLE 4

| Component - mol fraction | Rich Gas Feed | Conventional Sales Gas | Enhanced Sales Gas |
|---|---|---|---|
| Helium | 0.000993 | 0.001081 | 0.001085 |
| Nitrogen | 0.008428 | 0.009176 | 0.009212 |
| CO2 | 0.007692 | 0.008321 | 0.008407 |
| H2S | 0.000002 | 0.000002 | 0.000002 |
| Methane | 0.721123 | 0.784952 | 0.788098 |
| Ethane | 0.144403 | 0.156153 | 0.156904 |
| Propane | 0.073780 | 0.034538 | 0.036099 |
| i-Butane | 0.011130 | 0.002296 | 0.000159 |
| n-Butane | 0.021026 | 0.003042 | 0.000034 |
| i-Pentane | 0.004011 | 0.000237 | 0.000000 |
| n-Pentane | 0.003884 | 0.000166 | 0.000000 |
| Hexane | 0.001685 | 0.000022 | 0.000000 |
| Heptane | 0.001176 | 0.000010 | 0.000000 |
| Octane | 0.000574 | 0.000002 | 0.000000 |
| Nonane | 0.000078 | 0.000000 | 0.000000 |
| Decane + | 0.000014 | 0.000000 | 0.000000 |
| | 1.000000 | 1.000000 | 1.000000 |

Process

| Parameter | Units | Conventional | Enhanced | |
|---|---|---|---|---|
| Rich Gas Feed Rate | MMscfd | 26.3 | 26.3 | |
| Sales Gas HCDP | ° F. at 800 Psig | −5.8 | −18.0 | |
| Cold Sep. Temperature | ° F. | −13.0 | −29.2 | |
| Cold Sep. Pressure | Psig | 490 | 480 | |
| Chiller duty | MMbtu/hr | 4.35 | 3.61 | |
| Refridge Compressor Load | HP | 1151 | 1154 | 0.3% |
| HC liq to Fractionator | bbl/day | 8416 | 2679 | |
| Fractionator Pressure | Psig | 300 | 300 | |
| Fractionator Ovhd. Vol. | MMscfd | 4.28 | 2.11 | |
| Overhead Compressor Load | HP | 144 | 63 | −56.3% |
| Frationator Reboiler Temp. | ° F. | 188 | 192 | |
| Fractionator Reboiler Duty | MMbtu/hr | 2.49 | 2.27 | −8.8% |
| HGL Product Volume | bbl/day | 1521 | 1599 | |
| Sales Gas Volume | MMscfd | 24.14 | 24.05 | −0.4% |
| Higher Heating Value | btu/scf | 1167 | 1157 | −0.9% |
| Propane Recovery | % of Feed | 57.00 | 55.23 | |
| i-Butane Recovery | % of reed | 81.05 | 98.69 | |
| n-Butane Recovery | % of Feed | 86.71 | 99.85 | |
| i-Pentane Recovery | % of Feed | 94.56 | 100.00 | |
| n-Pentane Recovery | % of Feed | 96.07 | 100.00 | |
| Hexane Recovery | % of Feed | 98.80 | 100.00 | |
| Heptane Recovery | % of Feed | 99.61 | 100.00 | |
| Propane Yield | bbl/day | 713.0 | 690.4 | |
| Butanes Yield | bbl/day | 536.6 | 628.6 | |
| C5+ Yield | bbl/day | 257.8 | 266.9 | |
| | | 1,507 | 1,586 | 5.2% |
| HGL-Product:Feed Ratio | bbl/MMscf | 60.82 | 63.93 | 5.1% |

Under the prescribed conditions, the present invention (Enhanced) is capable of achieving a lower Cold Separator temperature and consequently recovering higher amounts of HGL than when using the conventional refrigeration process (Conventional). Once again, the sales gas composition of the Enhanced process contains a lesser amount of butanes ($C_4$) and pentanes+ ($C_{5+}$) than does the Conventional process. As well, the utility requirements for the Overhead compressor load and Fractionation Reboiler Duty are significantly less.

EXAMPLES 3 and 4

Table 5 further shows the flexibility of the Enhanced process of the present invention using the same rich gas feed as in Example 1 and Example 2 above. Example 3 reflects the ability to reject propane into the sales gas stream, yet with high butane recovery in the HGL stream. Example 4 reflects the ability to direct both propane and butane into the sales gas stream to produce a de-butanized condensate ($C_{5+}$) product stream.

TABLE 5

| Component - mol fraction | — Rich Gas Feed | Example 3 Enhanced Propane Rejection Sales Gas | Example 4 Enhanced Butane Rejection Sales Gas |
|---|---|---|---|
| Helium | 0.000993 | 0.001038 | 0.001005 |
| Nitrogen | 0.008428 | 0.008817 | 0.008537 |
| CO2 | 0.007692 | 0.008043 | 0.007789 |
| H2S | 0.000002 | 0.000002 | 0.000002 |
| Methane | 0.721123 | 0.754234 | 0.730304 |
| Ethane | 0.144403 | 0.150850 | 0.146128 |
| Propane | 0.073780 | 0.074884 | 0.074431 |
| i-Butane | 0.011130 | 0.001593 | 0.011147 |
| n-Butane | 0.021026 | 0.000538 | 0.020250 |
| i-Pentane | 0.004011 | 0.000001 | 0.000324 |
| n-Pentane | 0.003884 | 0.000000 | 0.000084 |
| Hexane | 0.001685 | 0.000000 | 0.000000 |
| Heptane | 0.001176 | 0.000000 | 0.000000 |
| Octane | 0.000574 | 0.000000 | 0.000000 |
| Nonane | 0.000078 | 0.000000 | 0.000000 |
| Decane + | 0.000014 | 0.000000 | 0.000000 |
| | 1.000000 | 1.000000 | 1.000000 |

Process

| Parameter | Units | | |
|---|---|---|---|
| Rich Gas Feed Rate | MMscfd | 26.3 | 26.3 |
| Sales Gas HCDP | ° F. at 800 Psig | 10.4 | 48.0 |
| Cold Sep. Temperature | ° F. | −2.2 | 36.0 |
| Cold Sep. Pressure | Psig | 480 | 480 |
| Chiller duty | MMbtu/hr | 3.46 | 2.12 |
| Refridge Compressor Load | HP | 864 | 449 |
| HC liq to Fractionator | bbl/day | 3234 | 2233 |
| Fractionator Pressure | Psig | 270 | 100 |
| Fractionator Ovhd. Vol. | MMscfd | 3.89 | 2.94 |
| Overhead Compressor Load | HP | 128 | 262 |
| Fractinoator Reboiler Temp. | ° F. | 248 | 248 |
| Fractionator Reboiler Duty | MMbtu/hr | 3.51 | 2.55 |
| HGL Product Volume | bbl/day | 895 | 274 |
| Sales Gas Volume | MMscfd | 25.13 | 25.95 |
| Higher Heating Value | btu/scf | 1216 | 1279 |
| Propane Recovery | % of Feed | 2.99 | 0.41 |
| i-Butane Recovery | % of Feed | 86.32 | 1.15 |
| n-Butane Recovery | % of Feed | 97.56 | 4.94 |
| i-Pentane Recovery | % of Feed | 99.99 | 92.02 |
| n-Pentane Recovery | % of Feed | 100.00 | 97.86 |
| Hexane Recovery | % of Feed | 100.00 | 100.00 |
| Heptane Recovery | % of Feed | 100.00 | 100.00 |
| Propane Yield | bbl/day | 29.8 | 0.0 |
| Butanes Yield | bbl/day | 596.6 | 13.2 |
| C5+ Yield | bbl/day | 268.3 | 261.2 |
| | | 895 | 274 |
| HGL-Product:Feed Ratio | bbl/MMscf | 35.77 | 10.97 |

In Example 3, the results show a sharp separation between $C_3$ (propane) recovery at 2.99% and i-$C_4$ (i-butane) recovery at 86.32%. Example 4, under different operating conditions, shows a sharp distinction between n-$C_4$ (n-butane) recovery of 4.94%, and i$C_5$ (i-pentane) recovery of 92.02%.

Examples 1 to 4 demonstrate the flexibility of the present invention and enable one to respond to market conditions to maximize the profitability from a raw gas stream.

EXAMPLE 5

In Example 5, the process of the present invention is used (Enhanced refrigeration) to recover sales gas and HGL product. The cold separator is operated at −13° F. and 600 Psig and various gas feeds of varying richness were contemplated. The relative richness or amount of the heavier gaseous hydrocarbons, can be expressed in terms of gallons per mcf (thousand cubic feet), abbreviated as GPM. In this embodiment, GPM includes all hydrocarbon components heavier than methane and represents the total volume, in liquid gallons, contained in one thousand cubic feet of a particular gas at standard conditions.

Figure 4:
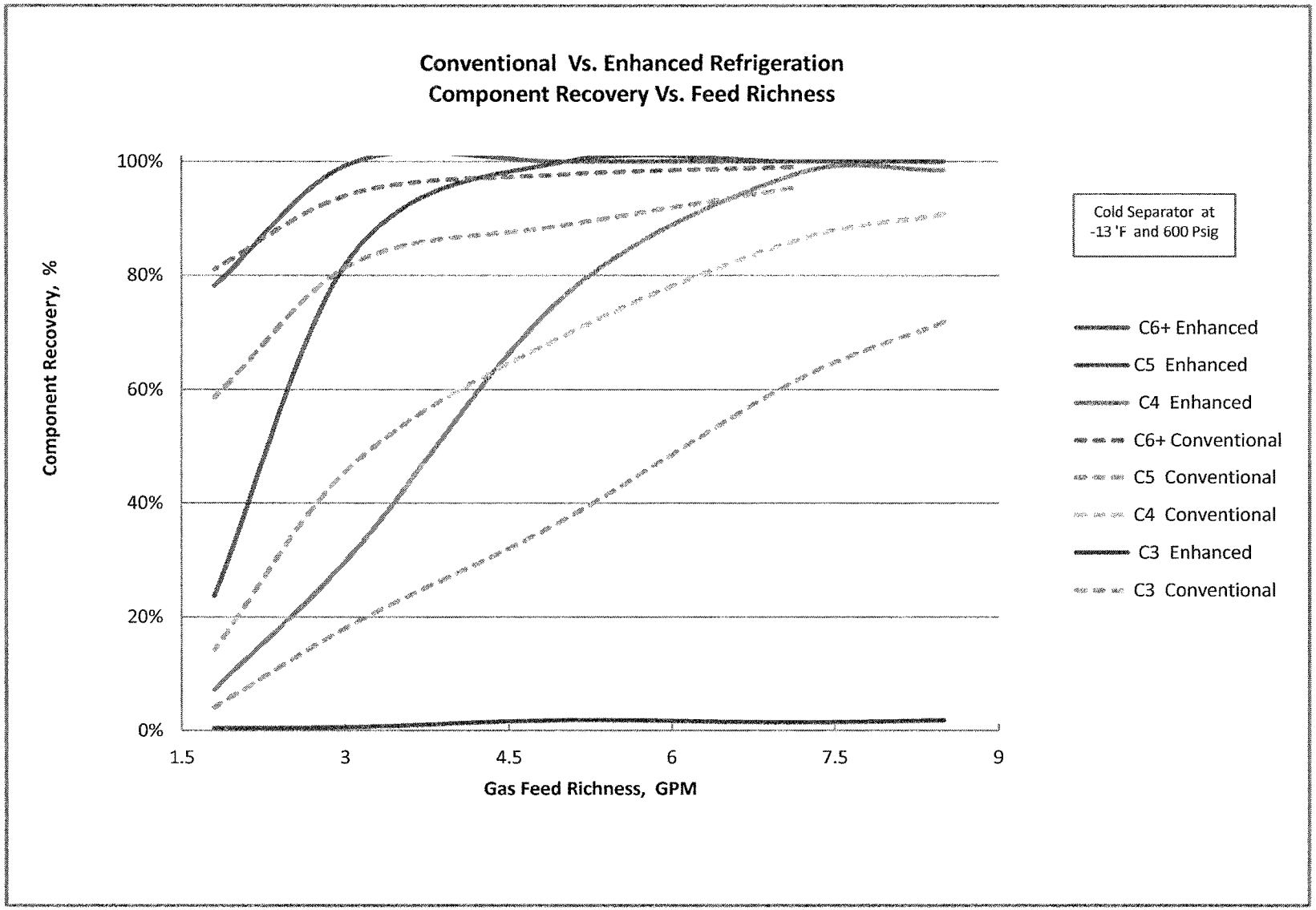
FIG. 4 is a graph showing the % recovery of $C_4$, $C_5$ and $C_6$+ hydrocarbons in a HGL stream from a hydrocarbon gas stream when using the process of the present invention (Enhanced) to effectively direct all the $C_3$ to the sales gas stream over a feed gas richness ranging from 1 to 9 GPM, (gal/mcf) in comparison to the conventional refrigeration process of the prior art.

Recovery of $C_6$+ (heavy hydrocarbons), $C_5$ (pentane) and $C_4$ (butane) in the HGL product were determined and the results are shown in FIG. 4. It can be seen from the graph in FIG. 4 that, in both the present invention (Enhanced) and the conventional process (Conventional), the component recoveries gradually increase with increasing gas richness. However, component recoveries in the present invention (Enhanced) exceed the component recoveries in the conventional process (Conventional) when using raw gas feed streams having richness of about 2 GPM and higher. It can be seen that for 4 GPM gas, very high recoveries, approaching 100% of $C_5$ and $C_6$+, can be recovered in the HGL stream (i.e., removed from the raw gas feed stream).

Also significant is the fact that, when using the present invention (Enhanced) with any of the raw gas feed richness examined, essentially no propane is recovered in the HGL product. Thus, when using the present invention (Enhanced), essentially the total amount of propane can report to the sales gas stream under selected conditions. However, as demonstrated in Example 2, a significant amount of propane recovery is possible.

EXAMPLE 6

Figure 5:
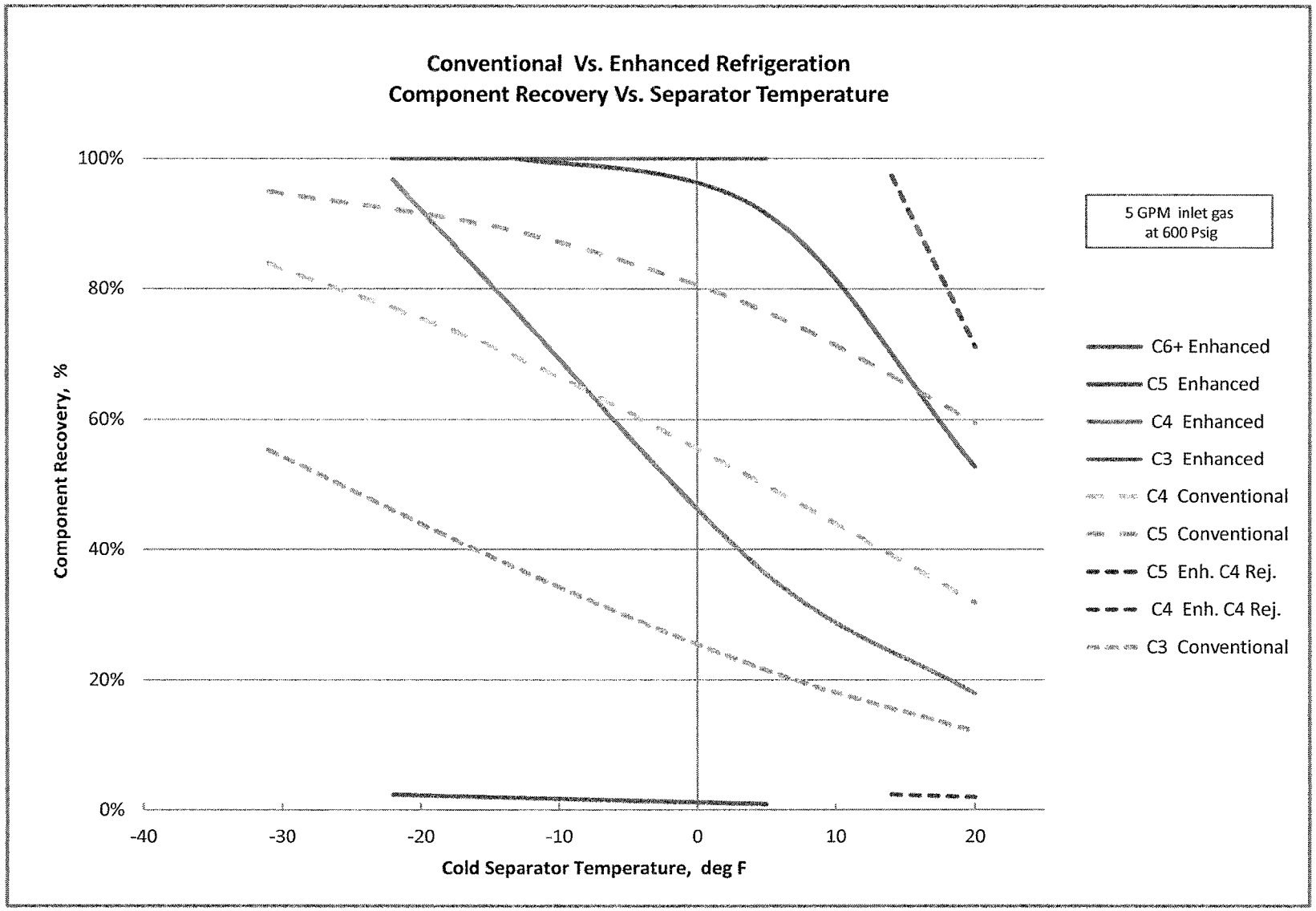
FIG. 5 is a graph showing the % recovery of $C_6$+, $C_5$, $C_4$, $C_3$, from a hydrocarbon gas stream having a richness of 5 GPM at a constant cold separator pressure of 600 Psig, and at various cold separator temperatures ranging between −40° F. and 20° F., using the process of the present invention (Enhanced) when directing effectively all the $C_3$ to the sales gas stream, in comparison to the conventional refrigeration process of the prior art.

In Example 6, the cold separator was operated at 600 Psig and various operating temperatures of the cold separator were contemplated using a raw gas feed stream having a richness of 5 GPM employing both the conventional prior art process (Conventional) and the process of the present invention (Enhanced). The graph in FIG. 5 shows that the cold separator can be operated at much higher temperatures in the present invention (Enhanced) for recovery of 100% of the $C_5$ and $C_6$+ hydrocarbons (in the HGL product) than when using the conventional refrigeration process (Conventional). In particular, at about −13° F., 100% of $C_5$ was recovered in the present invention (Enhanced) whereas only about 92% of the $C_5$ was recovered using conventional refrigeration process (Conventional). In fact, even at −25° F., only about 95% of the $C_5$ was recovered in the conventional refrigeration process (Conventional). Also at the −25° F. cold separator temperature, the present invention (Enhanced) is capable of recovering 100% of the butane, whereas about only 80% of the $C_4$ will also be removed by the conventional refrigeration process (Prior Art).

FIG. 5 also shows that, when it is desirable for butane to report to the sales gas stream and be rejected from the HGL stream, 97.4% $C_5$ recovery can be achieved at only 14° F. cold separator temperature. Further, it can be seen that for all temperature ranges, very little $C_3$ (propane) can be directed to the HGL product when using the present invention (Enhanced).

EXAMPLE 7

Figure 6:
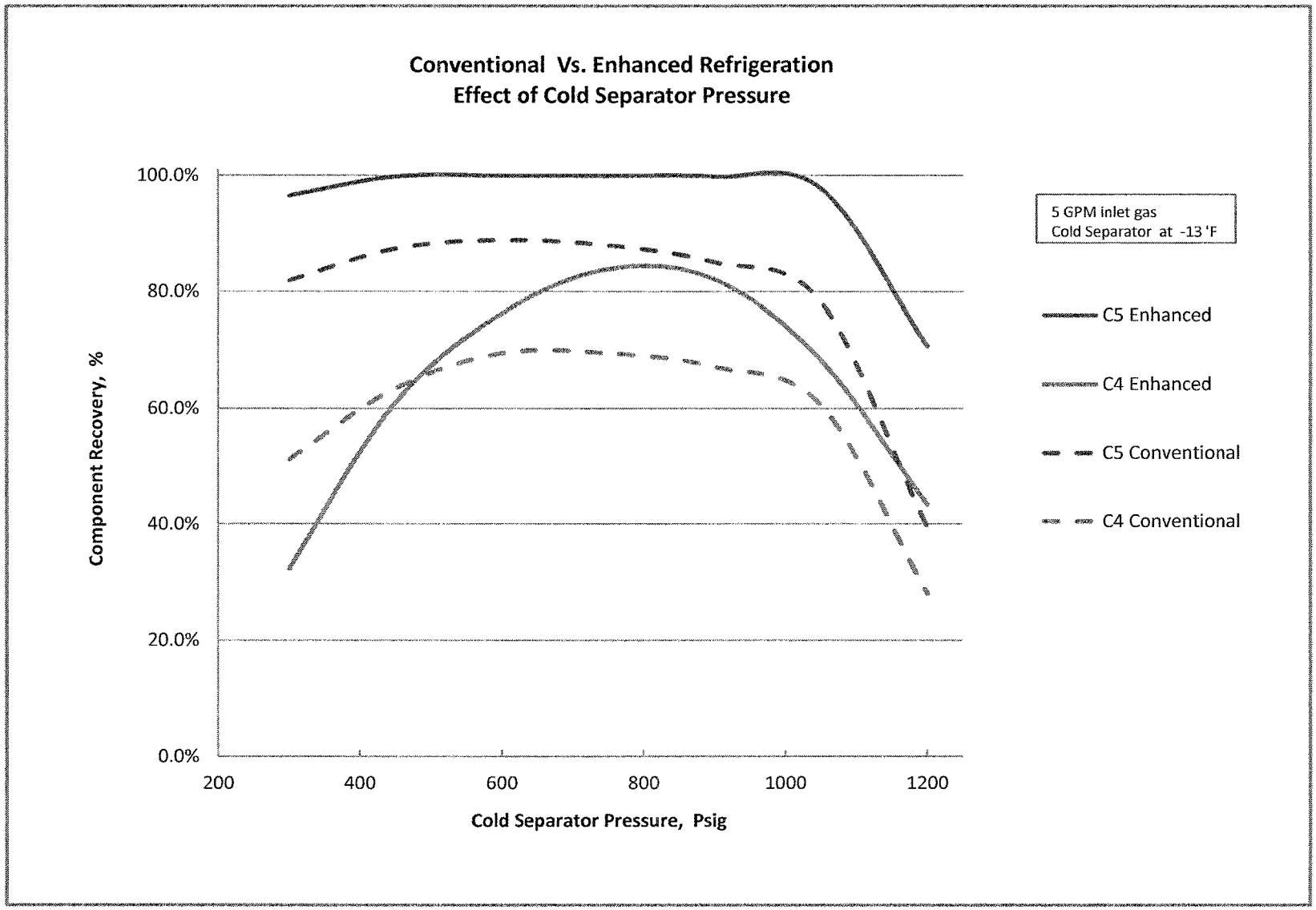
FIG. 6 is a graph showing the % recovery of $C_5$, and $C_4$, from a hydrocarbon gas stream having a richness of 5 GPM at a constant cold separator temperature of 13° F., and at various cold separator pressures between 200 Psig and 1200 Psig, using the process of the present invention (Enhanced) when directing effectively all the $C_3$ to the sales gas stream, in comparison to the conventional refrigeration process of the prior art.

In Example 7, the cold separator was operated at −13° F. and various operating pressures between 200 and 1200 Psig of the cold separator were contemplated, using a raw gas feed stream having a richness of 5 GPM. In this example, it was desirable to have all of the $C_3$ report to the sales gas stream and the majority of the $C_4$ and $C_5$ report to the HGL stream. Both the conventional prior art process (Conventional) and the process of the present invention (Enhanced) were investigated. The graph in FIG. 6 shows that the cold separator can be operated at a much broader range of pressures in the present invention (Enhanced) for recovery of 100% of the $C_5$ and $C_6$+ hydrocarbons (in the HGL product) than when using the conventional refrigeration process (Conventional). In particular, between 400 Psig and 1000 Psig, 100% of $C_5$ was recovered in the present invention (Enhanced) whereas only between 80% and 92% of the $C_5$ was recovered using the conventional refrigeration process (Prior Art).

FIG. 6 also shows that, when the pressure exceeds 500 Psig, that butane recovery in the Present Invention exceeds that of the conventional refrigeration process (Prior Art). In fact, the maximum butane recovery for the Present Invention (Enhanced) is about 84% and occurs at about 800 Psig, as compared to the Prior Art (Conventional) butane recovery at about 69%.

The present invention provides the potential to produce a sales gas stream meeting pipeline specifications at a higher pressure when compared to the Prior Art (Conventional). This may be an advantage when the gas transmission pipeline operates at pressures between 900 and 1200 Psig.

EXAMPLE 8

Figure 7:
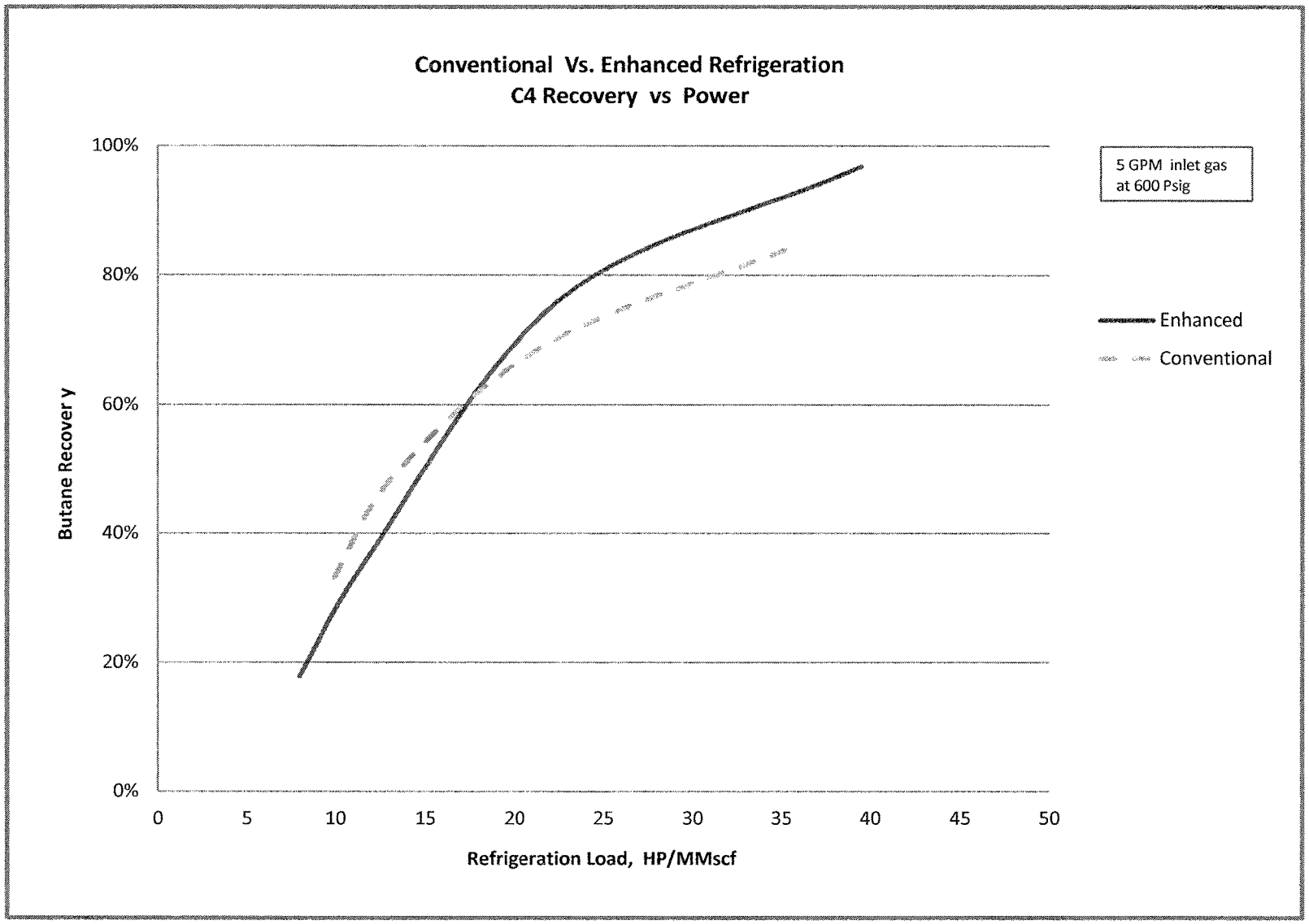
FIG. 7 is a graph showing the $C_4$ recovery versus refrigeration power for a hydrocarbon gas stream having a richness of 5 GPM using the process of the present invention (Enhanced) in comparison to the conventional refrigeration process of the prior art.

In Example 8, a gas feed stream having a richness of 5 GPM was used. The cold separator was operated at 600 Psi and various operating temperatures of the cold separator were tested using both the conventional prior art process (Conventional) and the process of the present invention (Enhanced). The butane recovery (%) versus refrigeration load (HP/MMscf) was determined. It can be seen in graph shown in FIG. 7 that when using and operating the cold separator over a range of temperatures, the refrigeration load for the present invention (Enhanced) becomes less than the refrigeration load for the conventional refrigeration process (Conventional) for equivalent butane recoveries (in the sales gas) greater than about 62%. In particular, at a target of 80% butane recovery in the sales gas, the refrigeration load for the process of the present invention (Enhanced) was only about 23 HP/MMscf of raw gas feed, as compared to about 32 HP/MMscf when using conventional refrigeration process (Conventional).

The scope of the claims should not be limited by the preferred embodiments set forth in the examples, but should be given the broadest interpretation consistent with the description as a whole.

I claim:

1. A process for separating a mixed or raw gas feed including natural gas, refinery gas, and synthetic gas, the gas feed containing methane, $C_2$ components, $C_3$ components, $C_4$ components and Cs+ components into a dry gas product containing methane and $C_2$ and a portion of $C_3$ components or $C_3$ and $C_4$ components selected by a user of the process, comprising:

(a) scrubbing heavier hydrocarbon components from the gas feed to produce a scrubbed gas stream having reduced $C_5$+ components and a first liquid stream;

(b) cooling the scrubbed gas stream and separating the cooled scrubbed gas stream into a second liquid stream containing a majority of $C_3$ components and the dry gas product containing the selected portion of $C_3$ components or $C_3$ and $C_4$ components;

(c) using the second liquid stream containing a majority of $C_3$ components to scrub the $C_5$+ components from the gas feed in step (a);

(d) distilling and/or fractionating the first liquid stream to form a hydrocarbon gas liquid product comprising the majority of $C_5$+ components and an overhead gas stream comprising $C_3$ components or $C_3$ and $C_4$ components; and (e) combining the overhead gas stream with the gas feed to produce the dry gas product containing the selected portion of $C_3$ components or $C_3$ and $C_4$ components.

2. The process as claimed in claim 1, further comprising cooling the gas feed prior to step (a) to reduce energy required in step (b).

3. The process as claimed in claim 1, wherein prior to combining the overhead gas stream with the gas feed the overhead gas stream is compressed.

4. The process as claimed in claim 1, wherein the hydrocarbon gas liquid product comprises the majority of the $C_{5+}$components present in the gas feed.

5. The process as claimed in claim 1, wherein the hydrocarbon gas liquid product comprises greater than 95% of the $C_{5+}$components present in the gas feed.

6. The process as claimed in claim 1, wherein the hydrocarbon gas liquid product comprises greater than 99% of the $C_{5+}$components present in the gas feed.

7. The process as claimed in claim 1, wherein when the gas feed has an amount of hydrocarbon components heavier than methane of greater than 2GPM, the hydrocarbon gas liquid product approaching 100% of $C_{5+}$and $C_{6+}$hydrocarbon components present in the mixed or raw gas stream.

8. The process as claimed in claim 6, wherein when the raw gas feed has an amount of hydrocarbon components heavier than methane of between 2 GPM and 9 GPM, the raw gas feed pressure ranges between 200 and 1050 Psig, and the scrubbed gas stream is cooled and separated at a temperature between −40° F. and +25° F., the hydrocarbon gas liquid product comprises all the $C_{5+}$components.

9. The process as claimed in claim 1, wherein the first liquid stream is fractionated in a fractionation tower operated at a range between 80 Psig to 350 Psig to produce the overhead gas stream and the hydrocarbon gas liquid product.

10. The process as claimed in claim 1, wherein the first liquid stream is flash distilled in a flash separator prior to step (d).

11. The process as claimed in claim 8, wherein the fractionation tower further comprises a reboiler and the reboiler temperature is selected in a range from 140° F. to 320° F., to reject the specified portion of $C_3$ and $C_4$ components from the first liquid stream to the overhead gas stream.

12. The process as claimed in claim 10, wherein the fractionation tower further comprises a reflux condenser for further separation of $C_3$ and/or $C_4$ components from the first liquid stream.

13. The process as claimed in claim 11, wherein prior to combining the overhead gas stream with the gas feed the overhead gas stream is compressed.

14. The process as claimed 12, wherein the operating pressure and temperature of the fractionation tower is dependent on what portion of the $C_3$and $C_4$ components are to be directed to the overhead gas stream.

15. The process as claimed in claim 2, wherein the gas feed is cooled in at least one heat exchanger.

16. The process as claimed in claim 1, wherein the scrubbing step (a) occurs in an absorber.

17. The process as claimed in claim 1, wherein the scrubbed gas stream is cooled in a cooling device selected from the group consisting of a Joule-Thompson expansion valve, gas chiller and waste heat/cold exchanger.

18. The process as claimed in claim 17, wherein the cooled scrubbed gas stream is separated into the second liquid stream and the dry gas product in a separator.

19. The process as claimed in claim 1, wherein step (d) occurs in a flash separator.

* * * * *